US007550045B2

(12) United States Patent
Hama

(10) Patent No.: US 7,550,045 B2
(45) Date of Patent: Jun. 23, 2009

(54) METAL SURFACE COATING TREATMENT DEVICE AND SURFACE COATED METAL MANUFACTURING METHOD

(75) Inventor: Nobuharu Hama, Hachinohe (JP)

(73) Assignee: Tamagawa Seiki Co., Ltd., Nagano (JP)

( * ) Notice: Subject to any disclaimer, the term of this patent is extended or adjusted under 35 U.S.C. 154(b) by 746 days.

(21) Appl. No.: 10/490,371

(22) PCT Filed: Sep. 26, 2002

(86) PCT No.: PCT/JP02/09990

§ 371 (c)(1),
(2), (4) Date: Sep. 20, 2004

(87) PCT Pub. No.: WO03/028901

PCT Pub. Date: Apr. 10, 2003

(65) Prior Publication Data

US 2005/0031800 A1 Feb. 10, 2005

(30) Foreign Application Priority Data

Sep. 29, 2001 (JP) ..... 2001-338751

(51) Int. Cl.
*B05C 3/00* (2006.01)

(52) U.S. Cl. ..... 118/423; 118/712

(58) Field of Classification Search ..... 118/423, 118/668, 694, 500, 712; 427/598, 435–438
See application file for complete search history.

(56) References Cited

FOREIGN PATENT DOCUMENTS

| | | | |
|---|---|---|---|
| JP | 56-17568 | * | 2/1981 |
| JP | 61-33671 | * | 2/1986 |
| JP | 62-168566 | * | 7/1987 |

* cited by examiner

*Primary Examiner*—Brenda A Lamb
(74) *Attorney, Agent, or Firm*—Fay Sharpe LLP

(57) ABSTRACT

A metal surface coating treatment device and a surface coated metal manufacturing method capable of providing excellent uniformness of coating thickness, excellent balance of weight, excellent appearance, and excellent feeling at the time of operation and contact, and having a large freedom degree of design of the amount of coating and size of coated metal, the metal surface coating treatment device comprising a magnetic floating means (1) for floating a treated metal (10) in the air, an optical control means with parts 2A, 2B, and 3 preventing the floated treated metal (10) from being magnetically attracted to the magnetic floating means (1) in vertical direction, a storage tank (9) positioned vertically coaxially with the magnetic floating means (1) and storing liquid coating material (11) used for the coating treatment of the treated metal (10), and a vertical moving means having a drive mechanism (7) for adhering the liquid coating material (11) to the treated metal (10) by immersing the treated metal (10) in the storage tank (9) by vertically moving the magnetic floating means (1), raising the treated metal (10) from the storage tank (9), and allowing to dry the liquid coating material (11) adhered to the surface of the treated metal.

3 Claims, 2 Drawing Sheets

METAL SURFACE COATING TREATMENT DEVICE AND SURFACE COATED METAL MANUFACTURING METHOD

TECHNICAL FIELD

The present invention relates to a metal surface coating treatment device and a surface coated metal manufacturing method. More particularly, it relates to a metal surface coating treatment device and a surface coated metal manufacturing method in technical fields in which, as in the case of coating of a metallic spherical body with a resin in manufacturing a track ball, high accuracy of uniformity of coating thickness and balance of weight, good appearance, and good feeling at the time of operation and contact are required, or a degree of freedom in design of the amount of coating and the size of coated metal is required.

BACKGROUND ART

A track ball is a position control unit used in various types of digital equipment such as a computer, medical apparatus, and radar console. A ball constituting the track ball is usually a metallic spherical body whose surface is coated with a resin. The track ball converts the direction of rotation and the travel distance given to the ball by a palm or finger into a pulse signal by using two detection shafts in contact with the ball and a rotary encoder. Therefore, the property of ball rotating in contact with the two detection shafts is an important condition for maintaining the detection accuracy and operability of track ball, so that high accuracy of uniformity of resin coating thickness and balance of weight is required.

The coating of a metallic spherical body with resin in manufacturing the above-described track ball has conventionally been accomplished by heat curing of resin powder or injection molding of molten resin.

FIG. 2 is an explanatory view showing a method for coating the metallic spherical body by heat curing of resin powder. In FIG. 2, the coating of the metallic spherical body with resin is accomplished by filling powdery or pellet-form resin 21 into a hollow formed by metal molds 12A and 12B so that a metallic spherical body 10 is contained therein and by forming a resin coating heat-cured on the surface of the metallic spherical body 10 by heating the resin 21.

In this method, however, it is not easy to dispose the metallic spherical body in the center of the ball, so that the thickness of resin coating becomes nonuniform at different places, and hence the balance of weight of ball sometimes becomes bad. Also, the amount of resin capable of being used for coating treatment and the size of metallic spherical body subjected to coating treatment are limited, and hence the degree of freedom in design is limited regarding the amount of coating and the size of metallic spherical body to be coated.

FIG. 3 is an explanatory view showing a method for coating the metallic spherical body by injection molding of molten resin. In FIG. 3, the coating of the metallic spherical body with resin is accomplished by hanging the metallic spherical body 10 in a hollow formed by metal molds 13A and 13B by using string-form supports 14A and 14B and by forming a resin coating on the surface of the metallic spherical body 10 by injection molding molten resin into the hollow.

However, in this method as well, it is not easy to dispose the metallic spherical body in the center of the ball, so that the thickness of resin coating becomes nonuniform at different places, and hence the balance of weight of ball sometimes becomes bad. Also, on the surface of the metallic spherical body 10 having been subjected to coating treatment, pores are produced at locations supported by the string-form supports 14A and 14B, which not only impairs the appearance but also presents a problem in view of maintenance of detection accuracy.

An object of the present invention is to provide a metal surface coating treatment device and a surface coated metal manufacturing method capable of solving the problems with the above-described background art, providing excellent uniformity of coating thickness, good balance of weight, good appearance, and good feeling at the time of operation and contact, and having a high degree of freedom in design of the amount of coating and the size of coated metal.

DISCLOSURE OF THE INVENTION

The inventor of the present invention conducted studies on the above-described problems, and resultantly found that the resin coating thickness on the ball surface can be made uniform by immersing a ball in molten resin in place of heat curing of resin powder or injection molding of molten resin and that the production of pores on the ball surface after coating treatment can be prevented by the use of magnetic means such as an electromagnet in place of string-form supports, which led to the present invention. Specifically, as means for solving the above-described problems, the inventions claimed in this application are the followings.

(1) A metal surface coating treatment device including magnetic floating means for floating a treated metal in the air; optical control means for preventing attraction of the floated treated metal to the magnetic floating means; a storage tank for storing a liquid coating material for coating treatment of the surface of the treated metal; and vertical moving means for vertically moving the magnetic floating means to immerse and pull up the treated metal in and from the storage tank.

(2) The metal surface coating treatment device of item (1), characterized in that the device further includes adjusting means for adjusting the liquid level of the liquid coating material in the storage tank to facilitate the pulling-up of the metal from the storage tank.

(3) The metal surface coating treatment device according of item (1) or (2), characterized in that the magnetic floating means uses an electromagnet, and the optical control means is provided with an optical sensor and a control circuit section.

(4) A surface coated metal manufacturing method including the steps of floating a treated metal in the air by magnetic floating means; maintaining the floating of the treated metal in the air while attraction of the floated treated metal to the magnetic floating means is prevented by optical control means; moving down the treated metal by the downward movement of vertical moving means provided with the magnetic floating means to immerse the treated metal in a liquid coating material with which the surface of the treated metal is coated, the liquid coating material being stored in a storage tank provided under the magnetic floating means; pulling up the metal, the surface of which is coated with the coating material by immersion, by the pulling-up of the vertical moving means; and drying the coating material adhering to the surface of the metal to form a coating.

(5) The surface coated metal manufacturing method of item (4), characterized in that after the immersion and before the metal is pulled up by the vertical moving means, at least some of liquid coating material in the storage tank is drained to adjust the liquid level of the liquid coating material, whereby the pulling-up of the metal is facilitated.

Figure 1:
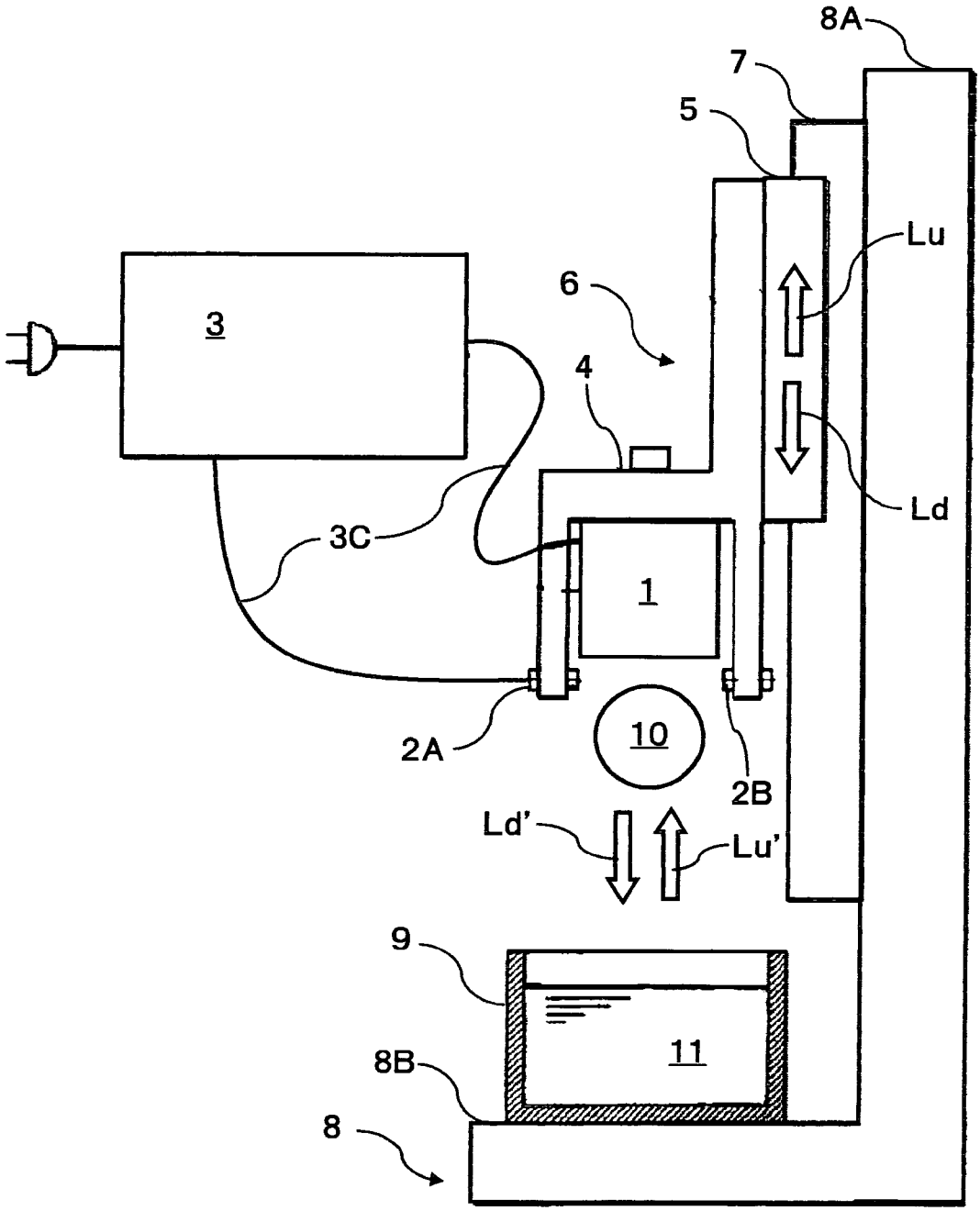
FIG. 1 is an explanatory view showing a general construction of a metal surface coating treatment device in accordance with the present invention, viewed from the cross-sectional direction.
Figure 2:
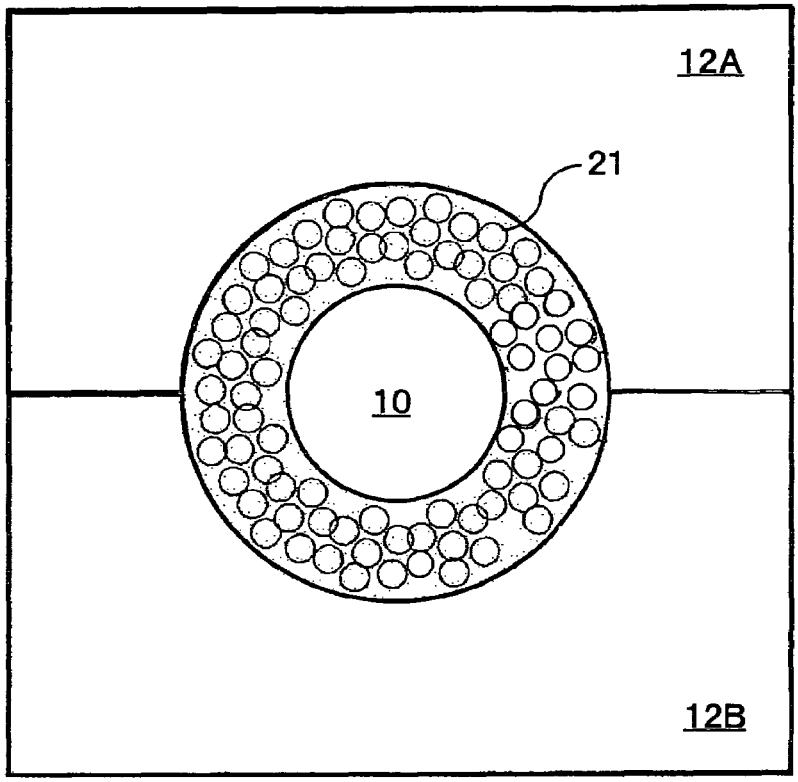
FIG. 2 is an explanatory view showing a conventional method for coating a metallic spherical body by heat curing of resin powder.
Figure 3:
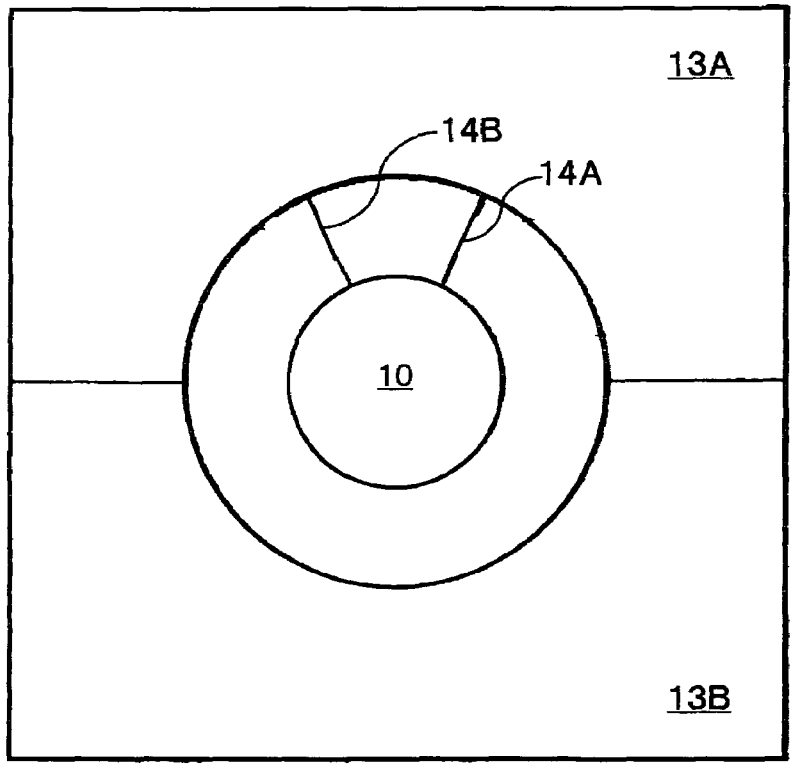
FIG. 3 is an explanatory view showing a conventional method for coating a metallic spherical body by injection molding of molten resin.

Reference numerals used in the figures denote the followings.

1 . . . Magnetic floating means, 2A, 2B . . . Optical sensor, 3 . . . Control circuit section, 3C . . . Transmitting means, 4 . . . Housing structure, 5 . . . Movable member, 6 . . . Floating control section, 7 . . . Drive mechanism, 8 . . . Bed, 8A . . . Supporting section, 8B . . . Mounting section, 9 . . . Storage tank, 10 . . . Treated metal, 11 . . . Liquid coating material, Lu, Lu' . . . Linear movement (upward), Ld, Ld' . . . Linear movement (downward), 12A, 12B, 13A, 13B . . . Metal mold, 14A, 14B . . . String-form support, 21 . . . Powdery or pellet-form resin

BEST MODE FOR CARRYING OUT THE INVENTION

The present invention will now be described in detail with reference to the accompanying drawings.

FIG. 1 is an explanatory view showing a general construction of a metal surface coating treatment device in accordance with the present invention, viewed from the cross-sectional direction. In FIG. 1, the device includes magnetic floating means 1 for floating a treated metal 10 in the air, an optical control means provided with elements 2A, 2B and 3 for preventing the floated treated metal 10 from being magnetically attracted to the magnetic floating means 1, a storage tank 9 positioned vertically coaxially with the magnetic floating means 1 to store liquid coating material 11 used for the coating treatment of the treated metal 10, and vertical moving means having a drive mechanism 7 etc. for performing vertical movement to adhere the liquid coating material 11 to the treated metal 10 by immersing the treated metal 10 in the liquid coating material 11 in the storage tank 9 by vertically moving the magnetic floating means 1 and to dry the liquid coating material 11 adhering to the surface of the treated metal 10 by raising the treated metal 10 from the storage tank 9.

Referring to FIG. 1, the elements 2A and 2B of constituent elements of the optical control means and the magnetic floating means 1 are provided in a housing structure 4, and a floating control section 6 for controlling the floating of the treated metal 10 in the air is constructed by 1, 2A, 2B and 4. The floating control section 6 is fixed to a movable member 5 capable of moving vertically.

The vertical moving means includes a drive mechanism 7 which is mounted with a movable member 5 and is moved linearly by an electric motor, described later, and the electric motor, not shown, for driving the drive mechanism 7. The drive mechanism 7 is provided on a pillar-shaped supporting section 8A of a bed 8, described later.

The bed 8 consists of the supporting section 8A and a mounting section 8B, and the storage tank 9 is provided on the mounting section 8B so as to be positioned under the magnetic floating means 1 in the vertical direction.

In the present invention, as the magnetic floating means 1, an electromagnet, for example, an electromagnetic holder (KE4B, manufactured by KANETEC Co., Ltd.) can be used.

The optical control means includes the optical sensors 2A and 2*b* which are on the housing structure 4 on the side lower than the magnetic floating means 1 to detect the approach of the treated metal 10 to the magnetic floating means 1, a control circuit section 3 for processing a signal detected by the sensor elements 2A and 2B and controlling the operation of the magnetic floating means 1, and transmitting means 3C for transmitting the feedback from the sensor 2A and the output to the magnetic floating means 1 by connecting the sensor 2A to the control circuit section 3 and connecting the control circuit section 3 to the magnetic floating means 1.

The storage tank 9 can be provided additionally with adjusting means, not shown, which makes adjustment such that at least some of the liquid coating material 11 stored in the storage tank 9 is discharged to the outside of the storage tank 9 by drawing up or draining off the liquid coating material 11, by which the liquid level is reduced in order to facilitate the pulling-up of the treated metal 10 from the storage tank 9. In this case, the adjusting means can be configured so as to make adjustment such that the liquid level is raised again by returning the liquid coating material 11 discharged once to the outside of the storage tank 9 again to the storage tank 9 after the immersed treated metal 10 has been pulled up.

As the drive mechanism 7 constituting the vertical moving means, for example, a linear guide or a ball screw can be used. Also, the vertical moving means can be provided with detecting means, not shown, for detecting the linear movement of the movable member 5, the rotation of ball screw, etc. as a signal and a control unit, not shown, for controlling the drive of the drive mechanism 7 by means of the electric motor by processing a signal detected by the detecting means.

As the treated metal subjected to treatment by the device in accordance with the present invention, iron can be cited. However, any magnetic material capable of being floated by the magnetic floating means such as an electromagnet comes under the metal to be treated in accordance with the present invention.

In manufacturing a ball for a track ball, the shape of the treated metal is spherical. However, the shape of the treated metal subjected to treatment by the device in accordance with the present invention is not limited to a sphere, and the device can be used for a metal having various shapes.

In manufacturing the ball for the trackball, as the liquid coating material used for coating treatment, for example, molten resin is used. However, in the present invention, the liquid coating material is not limited to molten resin.

In FIG. 1, since the device in accordance with the present invention is constructed as described above, the treated metal 10 is brought close to the magnetic floating means 1 of the device from the downside in a state of being held by approaching means, not shown, and is floated in the air just under the magnetic floating means 1 even after the approaching means has been removed by the magnetic floating means 1 having magnetic force attracting a metal such as iron.

The floated treated metal 10 is kept floating in the air just under the magnetic floating means 1 while being prevented from being attracted to the magnetic floating means 1 by the action of the optical control means consisting of 2A, 2B and 3, described later.

If the treated metal 10 is attracted to the magnetic floating means 1 and rises to approach the magnetic floating means 1, and is going to approach the magnetic floating means 1 beyond a line connecting the optical sensors 2A and 2B, which are located on the housing structure and fixed on the side lower than the magnetic floating means 1, to each other, the approach of the treated metal 10 to the magnetic floating means 1 is detected as an electrical signal by the optical detecting function of the sensors 2A and 2B.

The electrical signal detected by the function of the sensors 2A and 2B is subjected to information (signal) processing, in which sensor input information is sequentially output as control of strength with respect to the magnetic attracting operation of the magnetic floating means 1, by the control circuit section 3 relating to a closed loop constructed by (a) sensor, (b) control circuit section, and (c) magnetic floating means in that order via the transmitting means 3C such as wiring so that the treated metal 10 is not attracted to the magnetic floating means 1. and does not drop. A change in approaching state of the treated metal 10 based on an operation change of the magnetic floating means 1 due to the above-described information (signal) processing is again detected by the sensors 2A and 2B and is fed back to the control circuit section 3 to perform similar processing. Thereby, the floating of the treated metal 10 is maintained while the clearance between the treated metal 10 and the magnetic floating means 1 is kept within a predetermined range.

The drive mechanism 7 is moved linearly downward (Ld) by the drive of the electric motor, not shown, constituting the vertical moving means, and the movable member 5 mounted on the drive mechanism 7 and the floating control section 6 fixed to the movable member 5 are moved downward in association with the downward movement of the drive mechanism 7. Thereby, the treated metal 10, whose floating in the air just under the magnetic floating means 1 is maintained,. is moved downward (Ld') in association with the downward movement of the floating control section 6 with its floating being maintained, and is immersed in the liquid coating material 11 for coating treatment of the surface of the treated metal 10, which is stored in the storage tank 9 provided under the magnetic floating means 1. The magnetic floating means 1 is subjected to the control of necessary magnetic attraction force by the control circuit section 3 so that the treated metal 10 is completely sunk in the liquid coating material 11. Therefore, the treated metal 10 is completely sunk in the liquid coating material 11 and is immersed.

After the treated metal 10 has been immersed in the storage tank 9 for a predetermined period of time enough to adhere the liquid coating material 11 of an amount capable of coating treating the surface of the treated metal 10 to the surface thereof, the magnetic floating means 1 is located at a position at which the floating action due to magnetic attraction force sufficiently reaches the treated metal 10. The positioning method is such that the floating control section 6 is still located at a position at the time when the treated metal 10 is immersed in the liquid coating material 11 without being raised once. However, the present invention is not limited to this method.

The drive mechanism 7 is moved linearly upward (Lu) by the drive of the electric motor, not shown, constituting the vertical moving means, and the movable member 5 mounted on the drive mechanism 7 and the floating control section 6 fixed to the movable member 5 are moved upward in association with the upward movement of the drive mechanism 7. Thereby, the treated metal 10 in the storage tank 9 is pulled up from the liquid coating material 11 in the storage tank 9 in association with the upward movement of the floating control section 6 by receiving the floating action of the magnetic floating means 1, so that the treated metal 10, to the surface of which the coating material 11 is adhered by immersion, is raised (Lu') in association with the upward movement of the floating control section 6 while the floating is maintained.

The coating material 11 adhering to the surface of the pulled-up treated metal 10 is dried by drying means, not shown, and a coating is formed on the surface of the treated metal 10 by the coating material 11.

Before the treated metal 10 immersed in the liquid coating material 11 in the storage tank 9 is pulled up by the action of the vertical moving means, the liquid level of the liquid coating material 11 can be adjusted by discharging at least some of the liquid coating material 11 to the outside of the storage tank 9 by the adjusting means provided in the storage tank 9. The adjustment such that the liquid level is reduced can facilitate the pulling-up of the immersed treated metal 10.

EXAMPLE

As an example, a method for manufacturing a ball for a track ball using the present invention will be described.

In the device in accordance with the present invention, as the magnetic floating means 1, an electromagnet is used, and concretely an electromagnetic holder KE4B manufactured by KANETEC Co., Ltd. is used. As the drive mechanism 7, a linear guide is used. As the transmitting mean 3C, which is a constituent element of the optical control means, wiring is used. Also, as the liquid coating material 11, molten resin is used. Further, the storage tank 9 is provided with liquid level adjusting means. In the example described below, explanation is given by referring to the magnetic floating means 1 as the electromagnetic holder 1, the drive mechanism 7 as the linear guide 7, the liquid coating material 11 as the molten resin 11, and further the treated metal 10 as a spherical body made of iron (hereinafter referred to as "iron ball") 10.

The device is prepared so that the electromagnetic holder 1 is in an operable state. The iron ball 10 is brought close to the electromagnetic holder 1 from under the electromagnetic holder 1, and the iron ball 10 is floated in the air by the action of the electromagnetic holder 1 and the optical control means consisting of the optical sensors 2A and 2B and the control circuit section 3. The floating is maintained.

The linear guide 7 is driven (Ld) by the electric motor relating to the vertical moving means, by which the floating control section 6 and the iron ball 10 floating in association with the floating control section 6 are moved downward (Ld') to immerse the iron ball 10 in the molten resin 11 stored in the storage tank 9.

By the operation of the control circuit section 3, the magnetic attraction force of the electromagnetic holder 1 is weakened to completely sink the iron ball 10 in the molten resin 11.

After the iron ball 10 has been immersed for a predetermined period of time, the molten resin 11 in the storage tank 9 is drained from the storage tank 9 by the operation of the liquid level adjusting means so that about the upper half of the iron ball 10 appears above the liquid level.

By the operation of the control circuit section 3, the magnetic attraction force of the electromagnetic holder 1 is strengthened to float the iron ball 10 from the molten resin 11. The linear guide 7 is driven (Lu) by the electric motor to raise the floating control section 6 including the electromagnetic holder 1, by which the iron ball 10 is completely pulled up (Lu') from the storage tank 9.

The iron ball 10 is left floating in the air for a predetermined period of time to dry the molten resin 11 adhering to the surface of the iron ball 10, by which a ball for a track ball, in which the surface of the iron ball 10 is coated with resin, is manufactured.

INDUSTRIAL APPLICABILITY

According to the present invention, since the device is constructed as described above, a surface coated metal capable of providing excellent uniformity of coating thickness, good balance of weight, good appearance, and good feeling at the time of operation and contact, and having a high degree of freedom in design of the amount of coating and the size of coated metal can be manufactured, so that the present invention is useful.

Also, according to the present invention, since the device is constructed as described above, a ball for a track ball or the like capable of providing excellent uniformity of coating thickness, good balance of weight, good appearance, and good feeling at the time of operation and contact, and having a high degree of freedom in design of the amount of coating and the size of coated metal can be manufactured, so that the present invention is useful in a field of manufacture of a pointing device including the track ball.

The invention claimed is:

1. A metal surface coating treatment device comprising magnetic floating means for floating a treated metal in the air; optical control means for preventing attraction of the floated treated metal to said magnetic floating means; a storage tank for storing a liquid coating material for coating treatment of the surface of the treated metal; and vertical moving means for vertically moving said magnetic floating means to adhere the liquid coating material to the whole of surface of the treated metal by immersing and pulling up the treated metal in and from said storage tank, characterized in that said optical control means comprises an optical sensor for detecting approach of the treated metal being floated by said magnetic floating means to said magnetic floating means and a control circuit for processing a signal detected by said optical sensor to control strength with respect to magnetic attracting operation of said magnetic floating means.

2. The metal surface coating treatment device according to claim 1, characterized in that said device further comprises adjusting device capable of adjusting the liquid level of the liquid coating material in said storage tank by once draining at least some of the liquid coating material in said storage tank to the outside of said storage tank to facilitate the pulling-up of said treated metal from said storage tank.

3. The metal surface coating treatment device according to claim 1, characterized in that a floating control section for controlling the floating of the treated metal in the air is formed by providing the optical sensor and said magnetic floating means in a housing structure; said floating control section is fixed to a movable member capable of moving vertically, and said movable member is mounted on a drive mechanism moving linearly; said vertical moving means includes said drive mechanism and an electric motor for driving said driving mechanism; and said magnetic floating means uses an electromagnet.

* * * * *